United States Patent [19]

Smith

[11] 4,018,235

[45] Apr. 19, 1977

[54] ASH TRAY

[76] Inventor: April A. Smith, 2040 S. Hills Drive, Flagstaff, Ariz. 86001

[22] Filed: June 4, 1975

[21] Appl. No.: 583,757

Related U.S. Application Data

[63] Continuation-in-part of Ser. No. 570,012, April 21, 1975, abandoned.

[52] U.S. Cl. ..... 131/236

[51] Int. Cl.[2] ..... A24F 19/14

[58] Field of Search ..... 131/236, 256

[56] References Cited

UNITED STATES PATENTS

| | | | |
|---|---|---|---|
| 1,552,693 | 9/1925 | Gray | 131/236 |
| 1,597,374 | 8/1926 | Guy | 131/236 |
| 2,098,337 | 11/1937 | Edwards | 131/256 |
| 2,440,783 | 5/1948 | Peart | 131/236 |
| 2,871,864 | 2/1959 | Stair | 131/256 |
| 2,964,044 | 12/1960 | Bryan | 131/256 |
| 3,606,893 | 9/1971 | Verberg | 131/236 |
| 3,635,225 | 1/1972 | Andrews | 131/236 |

*Primary Examiner*—Robert W. Michell
*Assistant Examiner*—V. Millin
*Attorney, Agent, or Firm*—Drummond, Nelson & Ptak

[57] ABSTRACT

An upright vessel provided with a removable lid having a downwardly directed funnel member which depends through an opening in the top of the vessel. A disposable receptacle detachably suspended from the funnel member for receiving cigarette or cigar butts and ashes. In one embodiment the receptacle is fluid-permeable and fluid contained within the vessel permeates the disposable receptacle to extinguish lighted or smoldering ashes or butts. In another embodiment, the disposable receptacle is a fluid-impermeable integument provided with an inner fluid-absorptive lining which is maintained in a wet condition by an extinguishing fluid contained within the disposable receptacle.

2 Claims, 7 Drawing Figures

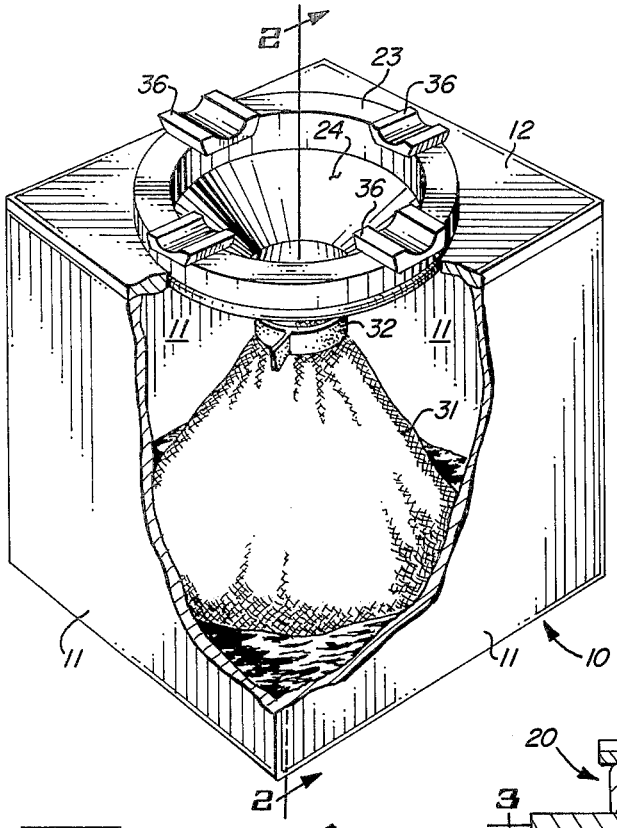
FIG. 1
FIG. 4
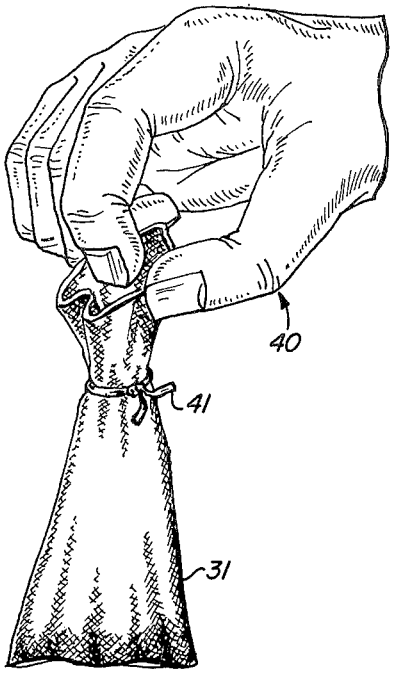
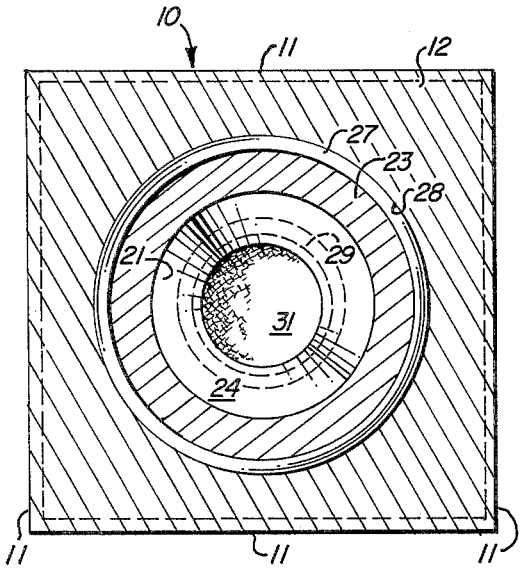
FIG. 3
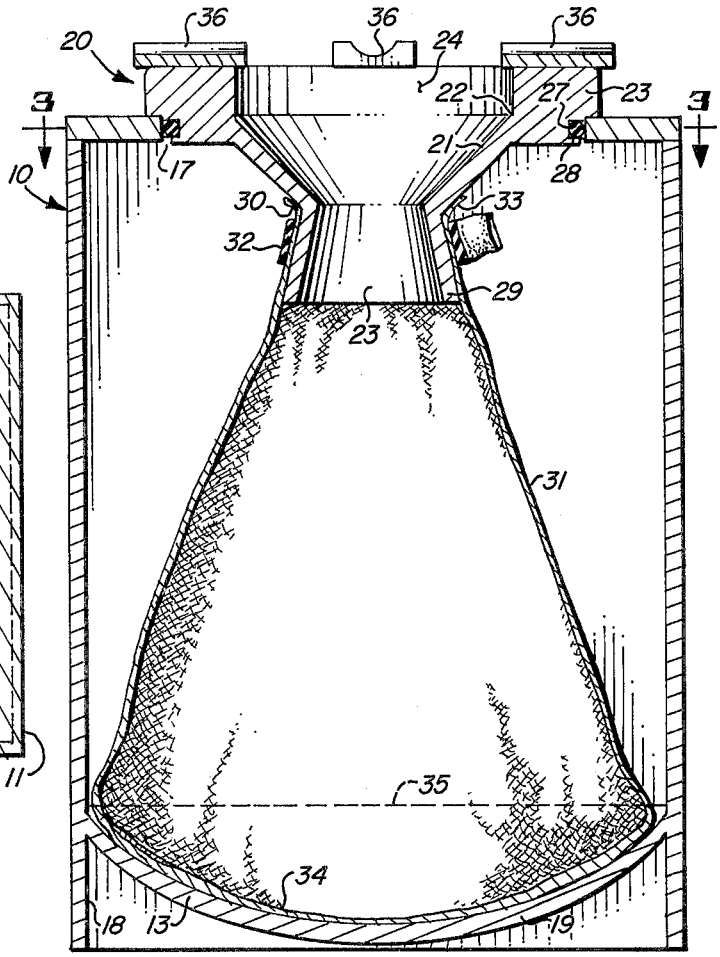
FIG. 2

ASH TRAY

This application is a continuation-in-part of my prior application Ser. No. 570,012, filed Apr. 21, 1975, entitled "Ash Tray Device" now abandoned.

This invention relates to ash trays.

More particularly, the instant invention relates to ash trays of the type having a disposable receptacle for receiving smokers' waste such as ashes and butts.

In a further aspect, the present invention concerns an ash tray having means for extinguishing lighted or smoldering waste deposited therein.

An important and disconcerting problem repeatedly encountered by smokers is the expedient disposition of waste such as cigar and cigarette butts and ashes from cigars, cigarettes and pipes. Frequently the refuse, or dregs, is still smoldering or even lighted. Depositing such material in a conventional ash tray can result in inconvenient, noxious or even disastrous consequences. A discarded cigarette or cigar butt, for example, which has not been properly extinguished can smolder for an extended period of time during which an extremely noxious and annoying odor is emitted. Ash tray fires are a common cause of inconvenience to smokers and if not properly attended can set fire to nearby items.

A further cause of concern, not only to smokers but to others as well, is the expedient disposal of accumulated refuse within an ash tray. Cleaning an ash tray is a particularly distasteful task due to the solidified and adhesive residue generally remaining in the ash tray after the loose waste has been emptied. It is conventional practice to pour the contents of the ash tray into a waste basket. The lightweight ash, however, being extremely susceptible to even mild air currents frequently settle on the area surrounding the ash tray. The waste deposited within the waste basket generally settles to the bottom thereof where it adheres, thus causing additional undue cleaning problems. Furthermore, if a lighted bit of refuse is deposited within the waste basket which normally contains paper and other combustible material, a fire of more or less serious proportions can ensue.

The prior art is replete with various ash tray schemes which purportedly minimize one or more of the foregoing problems. An extremely common type of device utilizes an ash-receiving funnel placed above a receptacle which is removable for disposing of the collected waste and for cleaning. An improved embodiment thereof includes a damper in the neck of the funnel to trap fumes which may emanate from smoldering ashes or butts. To insure that ashes and butts are extinguished, there have been provided various ash trays which receive the waste into a bowl of water. In another type of extinguishing ash tray, the material is first temporarily retained within a trap where it is wetted prior to passage to the refuse receptacle. And still other apparatus incorporate various containers such as empty milk cartons which are cut down to an appropriate size and placed within the device for receiving the waste therein.

However, none of the prior art devices have proven entirely satisfactory. Those in which the material is caught directly in water present problems associated with the disposal of the liquid mess and subsequent cleaning of the container. The dry-type units with detachable receptacles are generally inefficient in extinguishing and, of course, have associated cleaning problems. The milk carton type device is readily susceptible to fire unless containing water in which case the liquid must be disposed of separately from the carton.

It would be highly advantageous, therefore, to provide an improved ash tray which would adequately solve the aforementioned problem attendant the extinguishing and disposal of smokers' waste.

Accordingly, it is a principal object of the present invention to provide an ash tray device which extinguishes lighted or smoldering refuse deposited therein.

Another object of the present invention is the provision of an ash tray which is conveniently and readily emptied.

Still another object of the present invention is to provide an ash tray wherein the smokers' waste is automatically saturated with fire-extinguishing fluid.

Yet another object of the invention is the provision of an ash tray having provisions for the sanitary removal and disposal of refuse material.

Yet still another object of the invention is the provision of an ash tray having a disposable refuse receptacle.

And a further object of the present invention is to provide an ash tray of the above type which is economically produced, has an aesthetic appearance and is easily utilized.

The foregoing and further and more specific objects and advantages of the present invention will become more readily apparent to those skilled in the art from the following detailed description of the preferred embodiments thereof taken in conjunction with the drawings in which:

FIG. 1 is a perspective view of an ash tray device contructed in accordance with one embodiment of the invention having the outer portion thereof broken away to further illustrate the interior construction thereof;

FIG. 2 is a vertical, sectional view taken along the line 2—2 of FIG. 1, showing further details of the invention;

FIG. 3 is a plan view of the device of FIG. 1;

FIG. 4 is a perspective view particularly illustrating the means of disposal of the smokers' waste accumulated within the ash tray device of FIG. 1;

Figure 5:
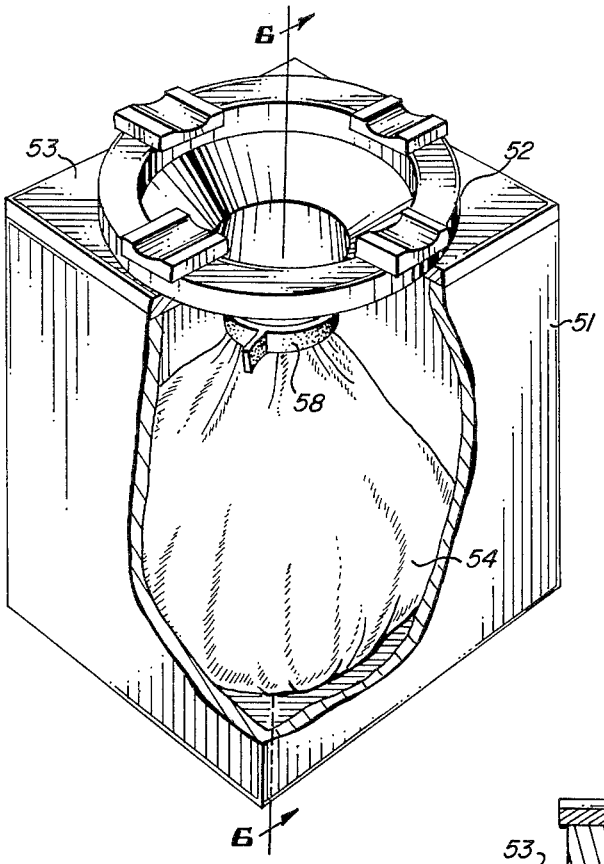
FIG. 5 is a perspective cut-away view of the presently preferred embodiment of the invention.

Briefly, in accordance with my invention, I provide an ash tray for receiving and extinguishing cigar, cigarette and pipe ashes and butts and for providing convenient and sanitary disposal of the smokers' waste accumulated therein. The ash tray contemplated by the present invention comprises an upright hollow vessel having an opening in the top thereof for receiving smoker's waste therethrough, a disposable receptacle detachably supported within said vessel and communicating with the opening in the top thereof for receiving said smokers' waste therein, and means for contacting the smokers' waste contained in said disposable receptacle with a fire-extinguishing fluid.

In accordance with one embodiment of the invention, the disposable receptacle is fluid-permeable and is detachably supported within the vessel in such manner that at least the lower portion thereof is suspended within a fire-extinguishing fluid contained within the lower portion of the vessel.

In accordance with the presently preferred embodiment of the invention, the disposable receptacle consists of a fluid-impermeable outer integument which is provided with an inner fluid-absorptive lining which is maintained in a wet condition by an extinguishing fluid contained within the disposable receptacle.

Turning now to the drawings in which the same reference numerals indicate corresponding elements throughout the several views, attention is first directed to FIG. 1 which shows an ash tray device constructed according to one embodiment of the present invention, having a vessel generally designated by the reference character 10 which forms the outer covering or case thereof. Although vessel 10 may assume any shape in accordance with the aesthetic desires of the individual designer, the instant vessel for purposes of general illustration is shown as a cubic structure having upright side walls 11 enclosed by top and bottom 12 and 13, respectively. As further seen in FIG. 2, top 12 has an opening 17 therethrough. Bottom 13 includes a generally planar perimeter 18 upon which the ash tray device rests and an upwardly arcuate center portion 19 which forms a semi-spherical bottom within vessel 10. The purpose of the semi-spherical bottom 19 will be described presently.

A lid generally designated by the reference character 20 and as further seen in FIG. 3, is removably carried by vessel 10. In accordance with the instant embodiment, lid 20 includes funnel member 21 having an upper end 22 and a lower end 23, upper end 22 being larger than lower end 23. Funnel member 21 is received through opening 17 and depends downwardly therefrom within vessel 10.

Flange 23 integrally formed with funnel 21 overlaps top 12 to prevent lid 20 from falling through opening 17. Central opening 24 of flange 23 is continuous with the upper end 22 of funnel 21. O-ring 27 carried within conventional O-ring groove 28 by lid 20 frictionally engages the perimeter of opening 17 for further retention of lid 20 with vessel 10 and also to effect a hermetic seal therebetween.

An outwardly flared member or inverted cone element 29 forming an extension of funnel member 21 from the lower end 23 thereof forms an external annular indentation 30.

A disposable fluid-pervious receptacle 31 as might be provided by a commercially available, appropriately sized filter bag depends from lid 20. Elastic band 32 closely residing within indentation 30 encircles the upper end 33 of filter element 31 for detachable securement of receptacle 31 to lid 20. The lower portion 34 of receptacle 31 is received and shaped by the curved surface 19 of bottom 13. A limited quantity of extinguishing fluid 35 such as water resides within the lower portion of vessel 10. For convenience, a plurality of rests 36 for holding cigars and cigarettes are arranged upon flange 23.

In preparation for use, a quantity of fluid is first introduced into vessel 10. Flared member 29 is inserted into the top of receptacle 31 and elastic band 32 secured thereabout. Lid 20 is inserted into vessel 10 through opening 12 with a slight amount of pressure to seal O-ring 27. Due to the curved surface 19 of bottom 13, it is immediately apparent that only a small quantity of fluid is necessary. Upon contact with fluid 35, the lower end 34 of receptacle 31 becomes saturated and softens to conform to curved surface 19. Obviously, various extinguishing fluids may be used; however, a preferred fluid is water due to the ready availability thereof and the fact that various essences or other air fresheners or deodorizers may be suspended therein. During use, butts, ashes, matches and other smokers' waste are deposited through opening 24 and funnel 21 to be received within receptacle 31. Due to the curvature of bottom 13, the refuse tends to be collected at the nethermost portion of lower end 34 of receptacle 31 where it is brought into immediate contact with the extinguishing fluid. Even if the fluid level is extremely low, a dry item of refuse will absorb extinguishing moisture from an adjacent wetted item. It is readily seen, therefore, that the novel construction of the ash tray device of the instant invention requires minimal fluid for effective operation.

After receptacle 31 has been partially filled with debris, lid 20 is withdrawn from vessel 10 upwardly through opening 17. Elastic band 32 is urged upwardly along funnel 21 and receptacle 31 removed for disposal. FIG. 4 illustrates a hand 40 as it would appear when holding receptacle 31 which has been removed from the ash tray device as previously described and ready for disposal. It is particularly noted that the entire removal and disposal may be carried out by touching only the top of receptacle 31, thereby avoiding soiling the hand as is generally unavoidable in cleaning conventional ash trays. To further enhance sanitary disposal and prevent accidental spillage of waste from within receptacle 31, twist tie 41 may be secured around the upper portion thereof. As is common practice in other arts, a quantity of twist ties 41 may be provided with the packaged supply of replacement receptacles 31. Cleaning of the present ash ray device is completed by periodically rinsing the carrier vessel 10 and replenishing the fluid supply. Since all waste materials are contained within receptacle 31, the fluid within vessel 10 will become stained or discolored which will necessitate rinsing the interior of the vessel, but eliminate scrubbing-type cleaning.

As previously noted, vessel 10 may be formed into any appropriate shape to conform to the immediate decor. Various arrangements can be substituted for the O-ring seal to effect coupling between the vessel and the lid. A curve reversed from that shown at the bottom of the vessel will likewise cause the debris to fall in a lowered portion thereof and reduce water requirements. Also, the double cone appearing shape of the lid is readily alterable to other configurations which can receive smokers' waste therethrough and support the upper end of the receptacle. In an even further arrangement, the receptacle may be supported directly by the vessel. Considering the instant arrangement, numerous spring clips, twist ties and other devices are immediately available as functional substitutes for the elastic band.

Figure 7:
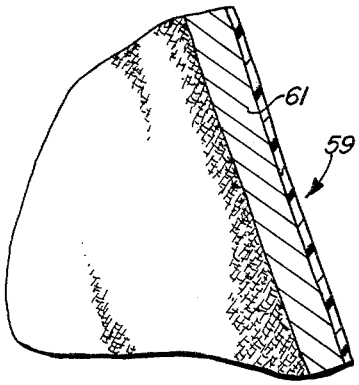
FIG. 7 is an enlarged sectional view of a portion of the disposable receptacle taken at the point indicated by the dashed circle 7 of FIG. 6.
Figure 6:
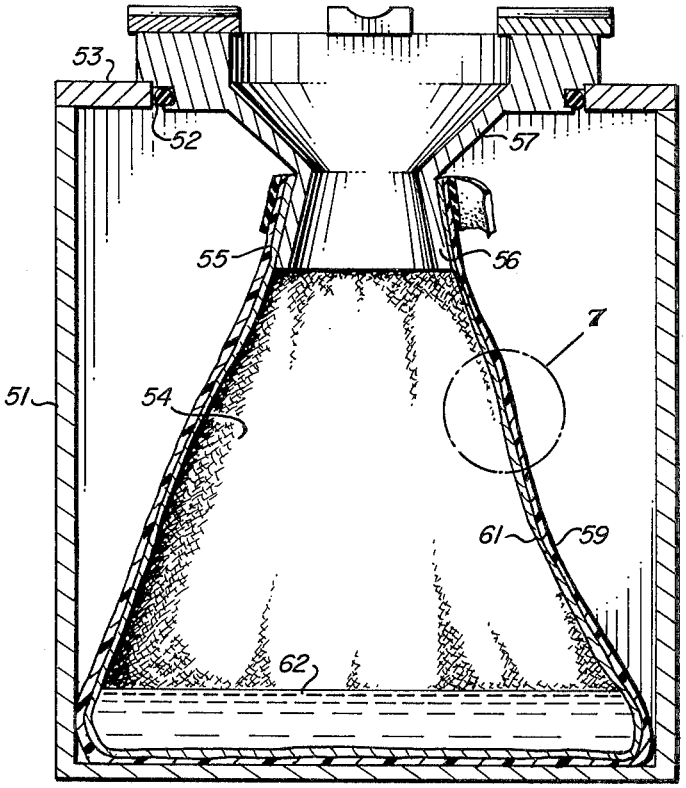
FIG. 6 is a cross-sectional view of the ash tray of FIG. 5 taken along section line 6—6 thereof.

Turning now to FIGS. 5–7 depicting for illustration the presently preferred embodiment of the invention, the ash tray incorporating this embodiment consists of an outer upright vessel 51 having an opening 52 in the top 53 thereof. A disposable receptacle 54 in the form of a flexible bag is detachably supported around the open neck portion 55 thereof to the lower portion 56 of a funnel member 57 extending downwardly through the opening 52. The neck portion 55 of the bag 54 is secured to the lower end 56 of the funnel portion 57 by any convenient means such as a rubber band 58 or other suitable fastener. The outer portion 59 of the disposable receptacle bag 54 consists of a fluid-impermeable integument and an inner layer 61 of a fluid-absorptive lining is carried on the inner surface of the receptacle 54.

The outer integument 59 may be formed of plastic, plastic-impregnated textile, metal foil or any other suitable fluid-impermeable material and the inner fluid-absorptive lining 61 may, for example, be formed of a textile, paper or any other suitable material which will, in effect, act as a wick to absorb and hold fire-extinguishing fluid, a suitable quantity of which 62 is maintained in the lower portion of the disposable receptacle 54. The water or other fire-extinguishing fluid 62 serves to extinguish any smoking materials which are dropped through the funnel member 57 into the interior of the disposable receptacle 54 and a sufficient amount of the fluid-extinguishing material 62 is absorbed by the inner absorptive lining 61 to prevent it from catching on fire as a result of contact with lighted butts or hot ashes.

When it is desired to empty the ash tray device, the funnel member and the attached disposable receptacle 54 are removed from the outer container 51 by lifting upwardly on the funnel member 57, the disposable receptacle 54 containing all of the water and extinguishing smoking waste is then detached from the lower end 56 of the funnel member 57 and disposed of.

In this way, in an even more effective and sanitary manner than that disclosed in FIGS. 1–4, one can achieve the aesthetic and sanitary object of the invention, disposing of the extinguished smokers' waste and the now contaminated extinguishing fluid 62 without touching any of the contents of the ash tray device and without leaving any portion of the extinguishing fluid in the outer container 51.

Having fully described and disclosed the instant invention in such clear and concise terms as to enable those skilled in the art to understand and practice the same, I claim:

1. An ash tray for receiving and extinguishing ashes and butts for providing for convenient and sanitary disposal of the smokers' waste accumulated therein, said ash tray comprising:

a. an upright hollow vessel having an opening in the top thereof for receiving smokers' waste therethrough;

b. a disposable flexible receptacle detachably supported within said vessel and communicating with the opening in the top thereof for receiving said smokers' waste therein; and c. means for contacting smokers' waste contained in said disposable receptacle with a fire-extinguishing fluid, said disposable receptacle being fluid-permeable and detachably supported within said vessel such that at least the lower portion thereof is suspended within a firek-extinguishing fluid contained within the lower portion of said vessel.

2. An ash tray for receiving and extinguishing ashes and butts for providing for convenient and sanitary disposal of the smokers' waste accumulated therein, said ash tray comprising:

a. an upright hollow vessel having an opening in the top thereof for receiving smokers' waste therethrough;

b. a disposable flexible receptacle detachably supported within said vessel and communicating with the opening in the top thereof for receiving said smokers' waste therein; and c. means for contacting smokers' waste contained in said disposable receptacle with a fire-extinguishing fluid, said disposable receptacle consisting of a fluid-impermeable outer integument and being provided with an inner fluid-absorptive lining which is maintained in a wet condition by an extinguishing fluid contained within said disposable receptacle.

* * * * *